United States Patent [19]

Radovich

[11] Patent Number: 4,837,958

[45] Date of Patent: Jun. 13, 1989

[54] INFLATABLE INDOOR/OUTDOOR DISPLAY FIGURE

[76] Inventor: JoAnn K. Radovich, 162 Elm St., Struthers, Ohio 44471

[21] Appl. No.: 145,472

[22] Filed: Jan. 19, 1988

[51] Int. Cl.[4] ..... G09F 1/08

[52] U.S. Cl. ..... 40/538; 40/606; 248/237; 248/520

[58] Field of Search ..... 40/538, 217, 606; 446/226; 248/520, 237

[56] References Cited

U.S. PATENT DOCUMENTS 2,748,256 5/1956 Moran ..... 446/226

*Primary Examiner*—Gene Mancene

*Assistant Examiner*—Michael Lynch

[57] ABSTRACT

An inflatable indoor/outdoor display figure is described in the nature of a stork 10. It is made free-standing by the use of a weighted bottom 36. FIGS. 1–4 on top of a rigid board-like material 38, which rests on the bottom panel 22 FIGS. 1–4, to give it a flat base. In FIGS. 1 and 2 the bottom panel 22 has reinforced holes 24 around its perimeter. Using mounting fasteners 26 it can be attached to the ground 28 for outdoor use. Adjustable straps 20 FIGS. 1 and 2 or the adjustable sleeve 42. FIGS. 3 and 4 can be pulled to various degrees to enable the inflatable figure to stand vertically on uneven or non-horizontal ground. An optional display area is also provided for permanent or non-permanent messages.

1 Claim, 3 Drawing Sheets

INFLATABLE INDOOR/OUTDOOR DISPLAY FIGURE

BACKGROUND - FIELD OF INVENTION

This invention relates to inflatable objects designed for indoor or outdoor uses that, when placed on non-horizontal or uneven ground, will stand erect and secure and can be written on to display a message.

BACKGROUND - DESCRIPTION OF PRIOR ART

Heretofore, inflatable articles were at best free standing with a weighted bottom. These and other inflatable objects were not suitable for outdoor use. They would fall over, blow away, or not stand erect. I did not find prior art on inflatable objects that had an area to display personal messages.

Many users would find it desirable to have an inflatable object which can be securely fastened to the ground for outdoor use, or stand unsecured for indoor use, and have a display area for messages.

OBJECTS AND ADVANTAGES

Accordingly I claim the following as the objects and advantages of the invention which differs in construction, operation and results from the prior art articles and devices.

One object of the present invention is to provide an inflatable indoor/outdoor display figure which can be packed away with relative ease and in a small amount of space.

Another object of the present invention is to provide an inflatable article which is attractive and eye-catching.

Another object of the present invention is to provide an inflatable indoor/outdoor display figure which is simple in construction and inexpensive to manufacture.

Another object is to provide an inflatable indoor/outdoor display figure with an area for permanent or non-permanent written messages.

Another object is to provide an inflatable indoor/outdoor display figure which can be free standing for office, party, or home use.

Another object is to provide an inflatable indoor/outdoor display figure which can be placed in the yard and be able to withstand a reasonable amount of wind and weather.

Another object is to provide an inflatable indoor/outdoor display figure which, when placed on uneven or non-horizontal ground, can still stand erect.

Another object is to provide an inflatable indoor/outdoor display figure which can be used in the celebration of holidays and special events.

BRIEF DESCRIPTION OF THE DRAWINGS

With the above and other such objects in view as may hereafter more fully appear, the invention consists of the novel constructions, combinations and arrangements of parts as will be more fully described and illustrated in the accompanying drawings; but it is to be understood that changes, variations and modifications may be resorted to which fall within the scope of the invention as claimed.

DESCRIPTION OF THE PREFERRED EMBODIMENT

Figure 1:
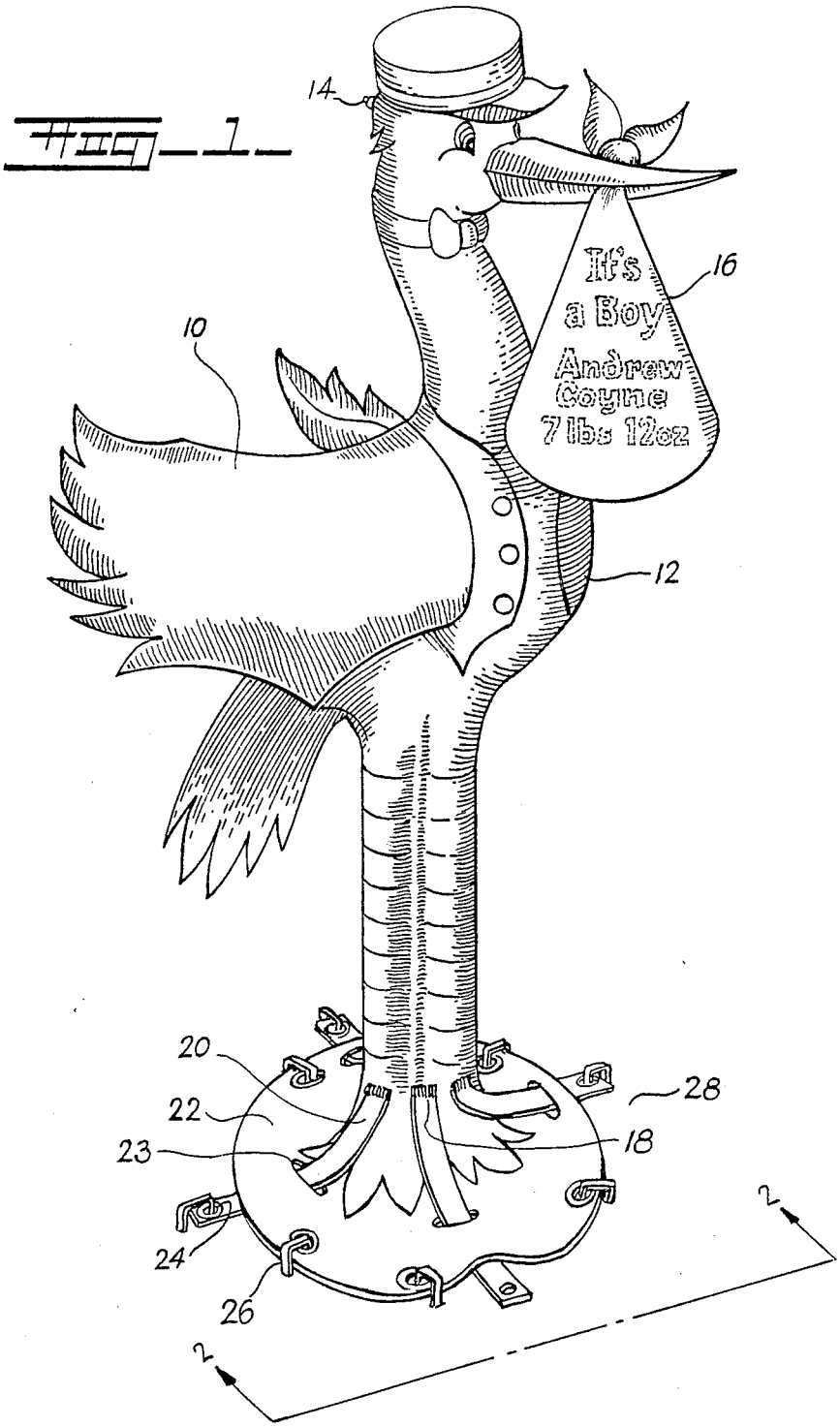
FIG. 1 is a perspective view of an inflatable indoor/outdoor display figure in the nature of a standing stork in accordance with the present invention.

While the inflatable object to be described is in the nature of a stork, it should be evident that the present invention can be used in conjunction with any other type of inflatable figure.

Referring specifically to the figures: Identical or similar parts are designated by the same reference numerals throughout and first referred to in FIGS. 1–2.

The inflatable object 10 is made of substantially flexible sheet material such as vinyl or any other such material commonly used for making inflatable toys or rafts, and is capable of being heat sealed to enclose an interior volume 30, causing it to become a semi-rigid structure, in this case a stork. Notation 14 refers to a valve disposed in the wall of 12 for inflating the form to provide it in an erect self-supporting condition by pressurizing the inside volume 30.

Another part of the invention is the written message area 16. This can be marked with a permanent or non-permanent magic marker.

Figure 2:
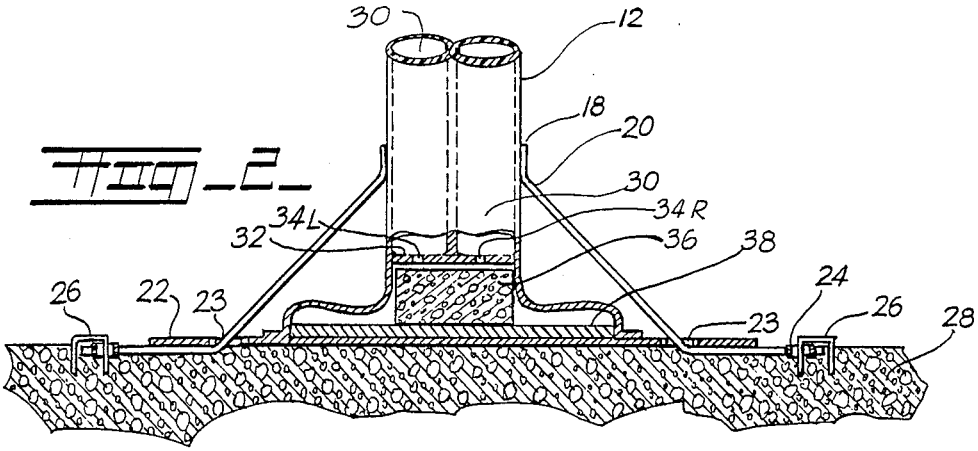
FIG. 2 is a fragmentary vertical sectional view of the lower portion of the embodiment shown in FIG. 1.

The inflatable body 12 is made to be self-supporting on a surface such as a floor 28 by means of a weighted base 36, referring to FIG. 2. This includes a covering panel 32 to keep the weight in place, with holes 34 left and 34 right to permit gas pressure to equalize on both sides of the panel. Below the weight is a piece of rigid board-like material cut in the shape of the base of the inflatable object. The bottom panel 22 is attached to the upper portion 12. As it is now, it will be free-standing on a flat, horizontal surface such as a floor. To better adapt it to the outdoor landscapes of an unlevel support surface, I have added straps 20 shown in FIG. 1 and 2. These straps 20 are heat sealed and attached at point 18 on the inflatable FIG. 12. These straps 20 then slip through holes 23 under the bottom panel 22, holes 23 are of optional use but give a more attractive and secure result. The straps may go directly into the ground. The straps 20 can be pulled to various degrees to enable the inflatable upper portion 12 to be in an upright position regardless of the pitch of the ground. These straps 20 are then secured to the ground by using a mounting fastener 26. The type of mounting fastener 26 I used were U shaped, but this is not to say that another type could not be used. The holes 24 that the mounting fastener 26 goes through have been reinforced with a metal ring. Again, another suitable material such as plastic could be used to prevent the material from tearing at this point.

Figure 3:
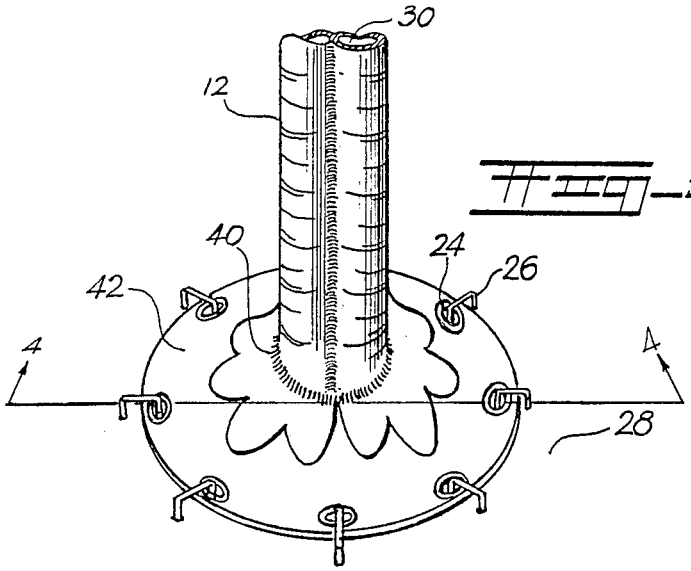
FIG. 3 is the bottom portion of the inflatable object showing an alternate means of construction to adjust for an incline or unlevel support surface.

FIG. 3 shows an alternate method of construction for FIG. 12. Rather than the adjustable straps 20 in FIG. 1 and 2, a sleeve 42 is used. This sleeve 42 surrounds the bottom part of the inflatable upper portion, which is attached at 40.

This sleeve 42 is non-inflatable. Pulling this sleeve 42 to various degrees will give the same effective means of adjusting the inflatable figure to an upright position as would the straps 20 in FIG. 1 and 2.

Figure 4:
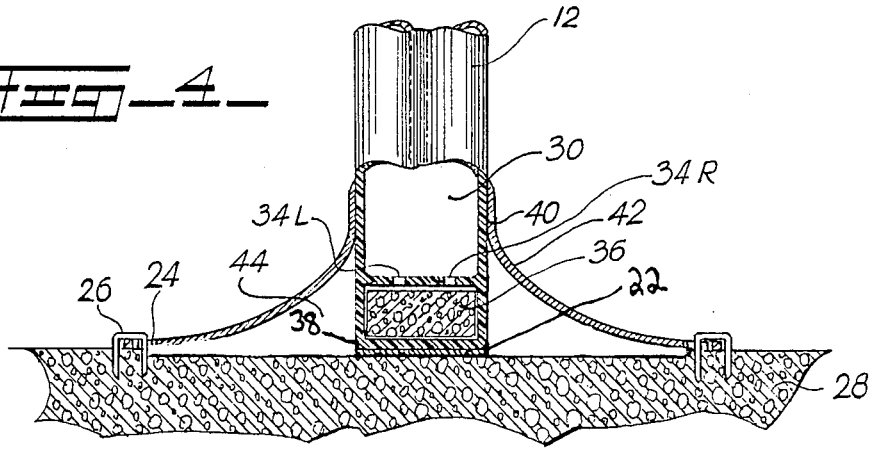
FIG. 4 is a fragmentary vertical sectional view of this bottom portion of the embodiment shown in FIG. 3.

FIG. 4 shows the inner construction of FIG. 3. Number 12 is the upper portion of the inflatable figure. Number 30 is the air volume contained within number 12. Number 32 is the covering panel which is so placed to keep the weight 36 in its proper area. Below the weight 36 is a rigid boardlike material 38 which rests on the bottom panel 22. The air space 44 beneath the sleeve 42 is not inflated. This sleeve attaches to the ground 28 in the same manner as the strap 20 and the bottom panel 22 in FIG. 1 and 2. By pulling this sleeve 42 in FIG. 3 and 4 and using the mounting fasteners 26 through the reinforced holes 24, one can adjust the inflated figure to stand in an upright manner.

Figure 5:
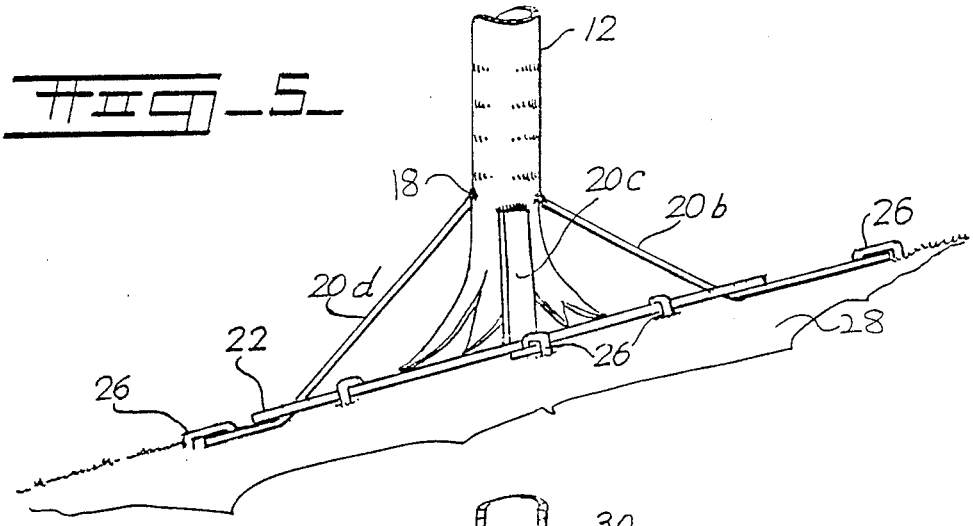
FIG. 5 is the bottom portion of the inflatable object showing it being secured to an unlevel support surface.

FIG. 5 shows the exterior bottom portion 12 of FIG. 1 as it would function on an unlevel support surface 28. Straps 20 are heat sealed and attached at point 18 on the inflatable figure. Adjustable straps 20 b,c, and d are being pulled to varying degrees to adjust to the incline of the support surface 28, with strap 20 b extending more outwardly than strap 20 d, pulling the upper portion 12 to stand in a vertical position. These straps pass through a hole on bottom panel 22 and are secured to the support surface by the use of mounting fasteners 26.

Figure 6:
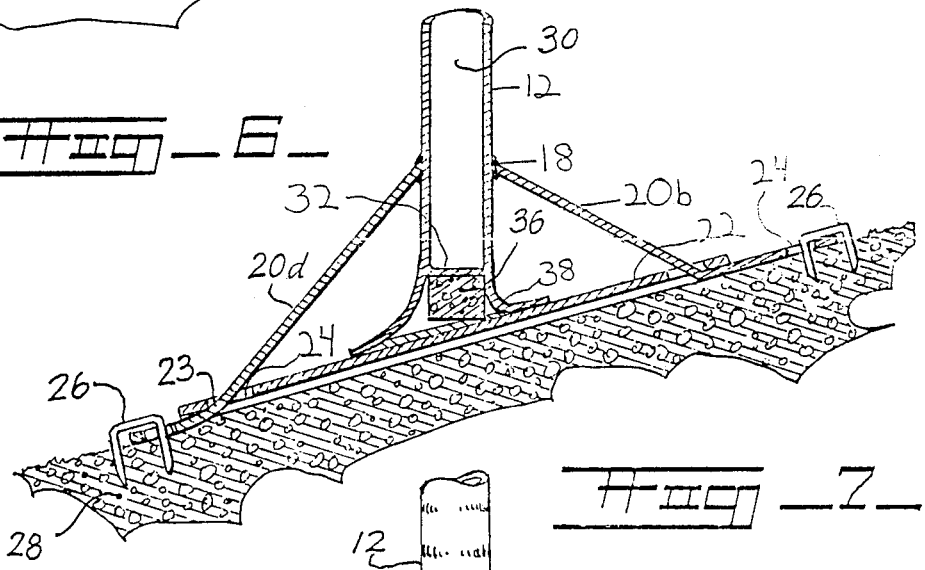
FIG. 6 is a fragmentary vertical sectional view of the lower portion of the embodiment shown in FIG. 1 being secured to an unlevel support surface.

FIG. 6 is a fragmentary vertical sectional view of the lower portion of the embodiment shown in FIG. 1. It is the same as the sectional view that is shown in FIG. 2; however, this view has been placed on an unlevel support surface 28 to further clarify the functional use of the adjustable straps 20b, c, and d. This interior structure is comprised of an interior air volume 30 and covering panel 32 which holds the weight 36 in place upon board-like material 38. This sits on the bottom panel 22. Straps 20 b and d, as shown in FIG. 5 and 6 are heat sealed and attached at point 18 on the inflatable FIG. 12. These straps 20, which can be pulled to varying degrees to enable the inflatable upper portion 12 to be in an upright position, then slip through holes 23 in the bottom panel 22. The straps 20 are then secured to the support surface 28 by using mounting fasteners 26.

Figure 7:
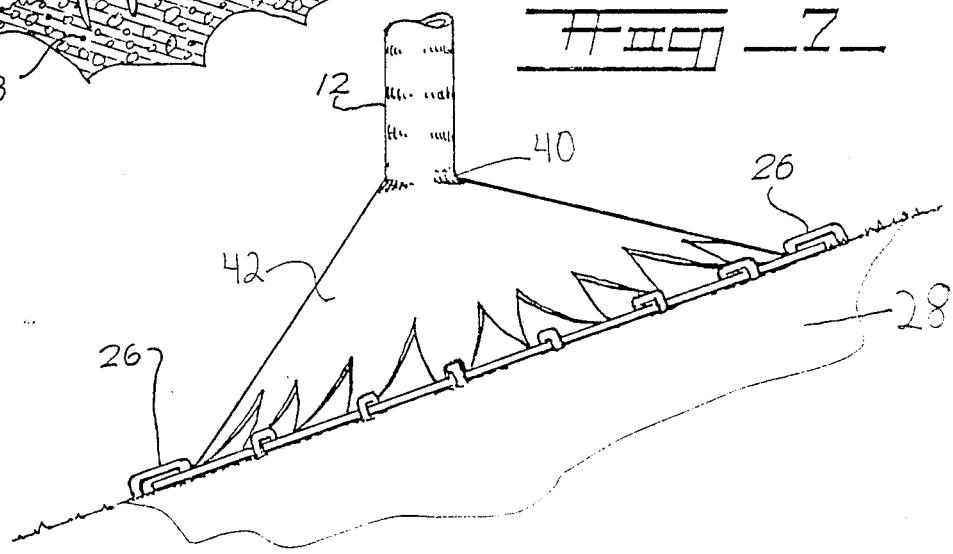
FIG. 7 is showing the alternate means of construction of FIG. 3 being placed on an unlevel support surface.

FIG. 7 shows FIG. 3 as it would function on an unlevel support surface. Rather than the adjustable straps 20, a sleeve 42 is used. This sleeve 42 surrounds the bottom part of the inflatable upper portion, which is heat sealed and attached at 40. This sleeve 42 can be pulled to varying degrees to adjust to an unlevel support surface 28 and secured in place by mounting fastener 26.

I have given two methods of construction for the bottom of the inflatable figure because each method may be more or less suitable than the other to different inflatable figures.

CONCLUSION AND SCOPE OF INVENTION

Conventional signs have been rather dull and expensive for the needs of the general public: mainly that of a one-dimensional material with changeable lettering - not very appealing for a child's birthday. My invention could be made in an endless variety of exciting forms that would be enjoyable for the consumer. The display area could be used for personal messages or for advertising purposes. By using a non-permanent magic marker on the display area 16, a store could use this same inflatable stork 10 to advertise a sale on infant sleepwear today or on baby bottles tomorrow. Rather than using a boring chalk board to advertise the day's lunch special, restraunts could use an inflatable chef. Not only can this indoor/outdoor inflatable figure be used for messages, it can also be a seasonal or holiday ornament, such as an Easter bunny, Santa Clause, or Halloween goblin.

It is understood that the foregoing description of the embodiment illustrated herein is exemplary; various modifications to the embodiment shown may be made without departing from the spirit and scope of the invention.

DRAWING REFERENCE NUMERALS

10 - inflatable sign
12 - inflatable upper portion
14 - inflation valve
16 - display area for written messages
18 - strap joining seam FIG. 12
20 - adjustable strap
21 - hole for straps to fit through
22 - bottom panel
24 - reinforced hole
26 - mounting fastener
28 - ground or floor
30 - air volume
32 - covering panel
34 L - equalizing air hole in left side
34 R - equalizing air hole in right side
36 - weight
38 - board-like material
40 - seam where sleeve meets 12
42 - sleeve
44 - non-inflatable air space

I claim:

1. An indoor/outdoor inflatable display figure comprising:

an inflatable member having a top and a bottom, a base member secured to the bottom of the inflatable member, said base member being circular, and having a plurality of slots inwardly of its peripheral edge, a plurality of strap members disposed in said slots, each of said strap members having two ends, a first end of each of said strap members secured to the bottom of the inflatable member; a second end of each strap member secured to a support surface, whereby said base is slideable on said straps, and one of the straps can be pulled through one of the slots, thereby moving the inflatable member relative to the base, enabling the inflatable member to maintain a vertical position regardless of the angle of the support surface to which the base is secured.

* * * * *